US007414012B2

(12) United States Patent
Imai et al.

(10) Patent No.: US 7,414,012 B2
(45) **Date of Patent: *Aug. 19, 2008**

(54) AQUEOUS LUBRICANT FOR PLASTIC WORKING OF METALLIC MATERIAL AND METHOD FOR FORMING LUBRICANT FILM

(75) Inventors: Yasuo Imai, Kanagawa Pref. (JP); Syuji Nagata, Kanagawa Pref. (JP); Masayuki Yoshida, Kanagawa Pref. (JP)

(73) Assignee: Henkel KGaA (DE)

( * ) Notice: Subject to any disclaimer, the term of this patent is extended or adjusted under 35 U.S.C. 154(b) by 55 days.

This patent is subject to a terminal disclaimer.

(21) Appl. No.: 10/360,492

(22) Filed: Feb. 7, 2003

(65) Prior Publication Data

US 2003/0130138 A1 Jul. 10, 2003

Related U.S. Application Data

(63) Continuation of application No. PCT/JP01/03640, filed on Apr. 26, 2001.

(30) Foreign Application Priority Data

Aug. 7, 2000 (JP) ..... 2000-237955

(51) Int. Cl.
*C10M 125/00* (2006.01)
*C10M 159/06* (2006.01)
*C10M 173/02* (2006.01)

(52) U.S. Cl. ..... 508/136; 508/143; 508/144; 508/154; 508/156; 508/157; 508/158; 508/165; 508/167; 508/170; 508/175; 508/450; 508/451; 508/537; 508/539

(58) Field of Classification Search ..... 508/157, 508/154, 158, 166, 167, 175, 176, 539, 136, 508/143, 144
See application file for complete search history.

(56) References Cited

U.S. PATENT DOCUMENTS

| | | | | |
|---|---|---|---|---|
| 4,403,490 | A * | 9/1983 | Sargent | 72/42 |
| 4,808,324 | A * | 2/1989 | Periard et al. | 508/115 |
| 6,194,357 | B1 | 2/2001 | Murata et al. | |
| 6,376,433 | B1 * | 4/2002 | Connor | 508/163 |
| 6,455,476 | B1 | 9/2002 | Imai et al. | |

FOREIGN PATENT DOCUMENTS

| | | |
|---|---|---|
| WO | WO 99/64544 | 12/1999 |

* cited by examiner

*Primary Examiner*—Ellen McAvoy
(74) *Attorney, Agent, or Firm*—Mary K. Cameron

(57) ABSTRACT

A waterborne lubricant, useful in the plastic working of metals, which imparts a lubricating behavior to the surface of metals in the absence of a conversion coating contains (A) water-soluble inorganic salt and (B) wax, wherein these components are dissolved or dispersed in water and the (B)/(A) solids weight ratio is 0.3 to 1.5. The (C) metal salt of a fatty acid can also be present at a (C)/(A) solids weight ratio of 0.01 to 0.4. The water-soluble inorganic salt (A) can be selected from the sulfates, silicates, borates, molybdates, and tungstates. The wax (B) can be a synthetic wax having a melting point of 70 to 150° C. A lubricating coating is formed by application to give a post-drying add-on of 0.5 to 40 g/m$^2$. A method for using said lubricant is also provided.

16 Claims, 2 Drawing Sheets

AQUEOUS LUBRICANT FOR PLASTIC WORKING OF METALLIC MATERIAL AND METHOD FOR FORMING LUBRICANT FILM

CROSS-REFERENCE TO RELATED APPLICATIONS

This application is a continuation of PCT/JP01/03640. This application claims priority from International Application Number PCT/JP01/03640, published in a non-English language, having an international filing date of Apr. 26, 2001, and to JP 2000-237955 filing date Aug. 7, 2000.

FIELD OF THE INVENTION

This invention relates to a waterborne lubricant for the plastic working of metals, such as iron, steel, stainless steel, titanium, and aluminum, that imparts an excellent lubricity to the surface of the metal and that does so without the execution of a conversion treatment on the metal surface. This invention also relates to a method for using said waterborne lubricant. More particularly, this invention relates to an aqueous solution containing water-soluble inorganic salt and wax and optionally fatty acid metal salt wherein these components are blended therein in specific ratios to form a waterborne lubricant for metals that can be used to form, without the execution of a conversion treatment, a highly lubricating coating on the surface of a metal, such as iron, steel, stainless steel, titanium, or aluminum, that will be subjected to plastic working, such as forging, wire drawing, or tube drawing. This invention also relates to a method for forming a lubricating coating.

BACKGROUND OF THE INVENTION

A lubricating coating is usually formed on the surface of a metal, such as iron, steel, or stainless steel, that will be subjected to plastic working in order to prevent the scuffing and galling that would be produced by metal-to-metal contact between the workpiece and tool. One type of lubricating coating that can be produced on the metal surface involves the physical attachment of lubricant to the metal surface. Another type involves the application of lubricant after the production of a conversion coating on the metal surface by a chemical reaction in a preliminary conversion treatment. Physical attachment of the lubricant on the metal surface provides a poorer adherence than use of the lubricant on a conversion coating elaborated on the metal surface, and as a result the former type is usually employed with light working processes. A phosphate coating or oxalate coating is produced on the metal surface when a conversion coating is used; this conversion coating functions as a carrier. A sliding lubricant is applied after the production of this conversion coating. This type, which has a two-layer structure of conversion coating (=carrier film) and lubricant, exhibits a very high resistance to galling and as a consequence has been used over a very wide range of applications in the plastics working sector for wire drawing, tube drawing, and forging. Within the realm of plastic working operations, the application of lubricant on an underlayer of a phosphate or oxalate coating is frequently used in particular in the severe working sector.

The lubricants applied on conversion coatings can also be broadly divided into two types depending on the method of application. One type involves physical attachment of the lubricant on the conversion coating, while the other type involves a reactive attachment of the lubricant on the conversion coating. The first type includes lubricants comprising an extreme-pressure agent added to a mineral, vegetable, or synthetic base oil. The first type also includes lubricants comprising a solid lubricant (e.g., graphite or molybdenum disulfide) dissolved along with a binder component in water; these lubricants are attached by drying. Since these lubricants can be simply applied by spraying or immersion, they offer the advantage of making bath management almost unnecessary. However, due to their low lubricity they are frequently used in relatively light lubricating environments. With regard to the second type, treatment is carried out with a reactive soap, such as sodium stearate, functioning as the lubricant. Reactive soaps are used as the lubricant in particular when a high lubrication performance is required. The reactive soaps have a high lubrication performance due to their reaction with the conversion coating.

The use of a reactive soap, however, requires bath management since a chemical reaction is involved, temperature management in order to control the chemical reaction, and waste disposal and bath renewal due to bath deterioration. Reducing the amount of industrial waste has recently become a major issue in view of the goal of global environmental protection. This has created demand for a lubricant and treatment method that do not produce waste. The complexity of process and treatment bath management in the prior-art technology has also made the appearance of a simple process desirable.

In order to solve the problems identified above, Japanese Laid-Open (Unexamined or Kokai or A) Patent Application Number Sho 52-20967 (20,967/1977) discloses a "lubricant composition comprising solid lubricant, a conversion coating-forming agent, and a base of water-soluble polymer or water-based emulsion thereof". This lubricant composition, however, does not match conversion coating treatments.

Another means for solving the problems under consideration is, for example, the invention in Japanese Laid-Open (Unexamined or Kokai or A) Patent Application Number Hei 10-8085 (8,085/1998), which is assigned to the present applicant. This invention relates to a waterborne lubricant for the cold plastic working of metals. This waterborne lubricant comprises (A) water-soluble inorganic salt; (B) solid lubricant; (C) at least one oil component selected from mineral oils, animal and vegetable fats and oils, and synthetic oils; (D) surfactant; and (E) water. The solid lubricant is present uniformly dispersed, while the oil is present uniformly emulsified. The lubricant provided by this invention is not stable in industrial applications due to the presence of the oil component in emulsion form, and this lubricant therefore does not provide a high lubricity on a stable basis.

Yet another means for solving the problems under consideration is, for example, the invention in Japanese Laid-Open (Unexamined or Kokai or A) Patent Application Number 2000-63880, which is assigned to the present applicant. This invention relates to a lubricant composition for the plastic working of metals. This lubricant composition contains (A) synthetic resin, (B) water-soluble inorganic salt, and water, wherein the solids weight ratio (B)/(A) is 0.25/1 to 9/1 and the synthetic resin is present dissolved or dispersed. The lubricant provided by this invention does not generate an acceptable lubricity on a stable basis under severe working conditions due to its use of synthetic resin as a main component.

SUMMARY OF THE INVENTION

This invention seeks to solve the problems identified above for the prior art. An object of this invention is to provide a waterborne lubricant for the plastic working of metals that can be applied to a variety of metals, does not require a conversion treatment and enables a simple treatment, and takes global environmental protection into consideration.

Another object of this invention is to provide a treatment method using this waterborne lubricant.

As a result of intensive investigations into means that would solve the problems identified above, the inventors discovered that an excellent lubrication performance is developed by an aqueous solution containing water-soluble inorganic salt and wax and optionally also fatty acid metal salt wherein these components are blended therein in specific ratios. This invention was achieved based on this discovery. The invention was also achieved based on the discovery of an energy- and space-saving treatment method that forms a lubricating coating at a specific coating weight on metal surfaces.

More specifically, this invention characteristically comprises a waterborne lubricant that contains (A) water-soluble inorganic salt and (B) wax wherein these components are dissolved or dispersed in water and the (B)/(A) solids concentration ratio is 0.3 to 1.5. This invention also comprises said waterborne lubricant that additionally contains (C) metal salt of a fatty acid wherein the (C)/(A) solids concentration ratio is 0.01 to 0.4. The water-soluble inorganic salt (A) is preferably at least one selection from the group consisting of sulfates, silicates, borates, molybdates, and tungstates. Specific examples of the inorganic salt include the group consisting of sodium sulfate, potassium sulfate, potassium silicate, sodium borate potassium borate, ammonium borate, ammonium molybdate, sodium molybdate, sodium tungstate and mixtures thereof.

The wax (B) is preferably a water-dispersed synthetic wax having a melting point of 70 to 150° C. In one embodiment, the wax is selected from the group consisting of microcrystalline waxes, polyethylene waxes, polypropylene waxes and carnauba wax.

The fatty acid metal salt (C) is preferably a fatty acid metal salt obtained by the reaction of C12-C26 saturated fatty acid with at least one metal selected from zinc, calcium, barium, aluminum, magnesium, and lithium.

The waterborne lubricant is preferably used in an amount that, upon bringing the cleaned metal into contact with said waterborne lubricant and then drying, causes the formation on the metal surface of a lubricating coating having an add-on weight of 0.5 to 40 g/m2. Prior to execution of this invention, the surface of the metal is preferably cleaned by the execution thereon of at least one selection from shotblasting, sandblasting, alkaline degreasing, and pickling. Contact with the lubricant is preferably effected after the metal has been heated to 60-100° C.

The invention provides a nonreactive method for forming a lubricating coating useful in the plastic working of metals on a metal surface comprising the steps of applying the waterborne lubricant at an add-on of at least 0.5 $g/m^2$ to a conversion-coating free metal surface; and drying the lubricant on the metal surface. Preferably, the waterborne lubricant is applied at a temperature of 50-90° C.

DETAILED DESCRIPTION OF A PREFERRED EMBODIMENT

Figure 1B:
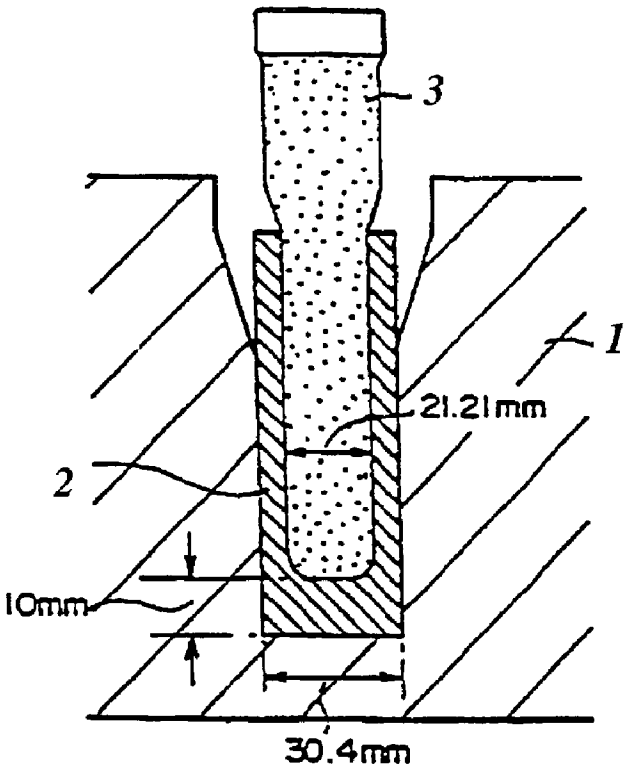
FIG. 1B shows a sectional view of a test specimen in the punch and die according to the backward punch test as the test is being performed.

The elements of this invention will be explained in greater detail in the following. The water-soluble inorganic salt (A) used in the inventive waterborne lubricant for the plastic working of metals (hereinafter referred to simply as the waterborne lubricant) functions to impart hardness and strength to the coating. The selected water-soluble inorganic salt must therefore dissolve uniformly in the solution and must form a solid coating film upon drying. Water-soluble inorganic salts with such properties preferably comprise at least one selection from the group consisting of the sulfates, silicates, borates, molybdates, and tungstates. These can be exemplified by sodium sulfate, potassium sulfate, potassium silicate, sodium borate (e.g., sodium tetraborate), potassium borate (e.g., potassium tetraborate), ammonium borate (e.g., ammonium tetraborate), ammonium molybdate, sodium molybdate, and sodium tungstate. These may be used individually or as combinations of two or more selections.

The wax (B) is not particularly restricted with regard to its structure and type, but the use of synthetic wax is preferred. The wax component is added in order to enhance the sliding properties of the coating by melting upon exposure to the heat generated during the plastic working operation. The wax should therefore have a melting point of 70 to 150° C. in order to manifest its activity in the initial working period, while the wax should also be stable in aqueous solution and should not impair the strength of the coating. The wax can be exemplified by microcrystalline waxes, polyethylene waxes, polypropylene waxes, and carnauba wax. These are preferably introduced into the inventive waterborne lubricant by mixing their water-based dispersion or water-based emulsion with the other components. The wax content preferably gives a value of 0.3 to 1.5 for the ratio (B)/(A) (solids weight ratio between the wax (B) and water-soluble inorganic salt (A)). The more preferred range for this ratio is 0.4 to 1.0. There is a risk that the sliding behavior of the coating will become unacceptable when this ratio is below 0.3, while a value in excess of 1.5 risks an unsatisfactory adherence by the coating.

The fatty acid metal salt (C) used by this invention provides lubricity. While its type is not critical, the use is preferred of fatty acid metal salt obtained by the reaction of C12-C26 saturated fatty acid with at least one metal selected from the group consisting of zinc, calcium, barium, aluminum, magnesium, and lithium. Among these the use is preferred of calcium stearate, zinc stearate, barium stearate, magnesium stearate, and lithium stearate. The fatty acid metal salt used by this invention is present in a dispersed state in the inventive waterborne lubricant, and as a consequence a known surfactant can be used as necessary or desired.

The blending ratio between the fatty acid metal salt (C) and water-soluble inorganic salt (A) preferably provides a solids weight ratio (C)/(A) of 0.01 to 0.4 and more preferably 0.03 to 0.2. A ratio below 0.01 does not pose any particularly significant problems, although in some cases the lubricity may be somewhat unsatisfactory depending on the degree of working. A ratio in excess of 0.4 is undesirable due to the associated decline in the stability of the lubricant bath.

An oil and/or solid lubricant may also be added to the inventive waterborne lubricant as an auxiliary when the inventive waterborne lubricant will be used in severe working operations.

Nonionic surfactant, anionic surfactant, amphoteric surfactant, or cationic surfactant can be used in those cases where surfactant is required in order to disperse the above-described fatty acid metal salt or wax. The nonionic surfactant is not critical and can be exemplified by polyoxyethylene alkyl ethers, polyoxyalkylene (ethylene and/or propylene) alkylphenyl ethers, polyoxyethylene alkyl esters originating from polyethylene glycol (or ethylene oxide) and higher fatty acid (e.g., C12-C18), and polyoxyethylene sorbitan alkyl esters originating from sorbitan, polyethylene glycol, and higher fatty acid (e.g., C12-C18). The anionic surfactant is also not critical and can be exemplified by the salts of fatty acids, sulfate ester salts, sulfonate salts, phosphate ester salts, and dithiophosphate ester salts. The amphoteric surfactant is again not critical and can be exemplified by amino acid-type and betaine-type carboxylates, sulfate ester salts, sulfonate salts, and phosphate ester salts. The cationic surfactant is also not critical and can be exemplified by the amine salts of fatty acids and by quaternary ammonium salts. These surfactants can in each case be used singly or in combinations of two or more selections.

The waterborne lubricant according to this invention can be applied to such metals as iron, steel, stainless steel, copper, copper alloys, aluminum, aluminum alloys, titanium, titanium alloys, and so forth. The shape of the metal is not critical, and one can contemplate application to the working of not only stock such as bar or block, but also shaped material (e.g., gears, shafts) after forging.

The inventive method for forming a lubricating coating on metals is a nonreactive method that is characterized by the formation of a lubricating coating at an add-on of 0.5 to 40 $g/m^2$ on the surface of a metal by bringing the cleaned, conversion coating-free metal into contact with lubricant as described above and then drying. The add-on of the lubricating coating formed on the metal surface should be adjusted as appropriate for the ensuing degree of working. The more preferred range is 2 to 20 $g/m^2$. The lubricity becomes unsatisfactory when this add-on is below 0.5 $g/m^2$. While there are no problems with lubricity at above 40 $g/m^2$, such values are undesirable because they result in clogging of the die by residues. The add-on is calculated from the surface area and the weight difference of the metal before and after treatment.

The quantity of waterborne lubricant solids (concentration) should be suitably adjusted so as to control the add-on into the above-specified range. A procedure frequently used in practical applications involves dilution of a concentrate of the lubricant and use of the resulting dilution as the treatment bath. The water used to make the dilution is not critical, but the use of deionized water or distilled water is preferred.

The conversion coating-free metal surface on which the invention will be executed is preferably a metal surface on which at least one selection from shotblasting, sandblasting, alkaline degreasing, and pickling has been executed. The purpose of this cleaning step is to remove oxide scale that has grown during, for example, annealing, and to remove various other contaminants (e.g., oil).

Environmental issues have recently made it desirable to reduce wastewater treatment loads. Zero wastewater can be achieved by cleaning the metal surface by shotblasting and then using the inventive lubricant and the described treatment method.

The procedure for applying the inventive waterborne lubricant to the metal is not critical and procedures such as immersion, flow coating, and spraying can be used. The coating time is also not critical as long as the surface becomes thoroughly coated with the waterborne lubricant. The waterborne lubricant must be dried after application. While this drying can be carried out by standing at ambient temperature, drying is preferably carried out at 60 to 150° C. for 1 to 30 minutes.

In order to enhance the drying performance, the waterborne lubricant is preferably brought into contact with metal already heated to 60 to 100° C. Moreover, contact is preferably carried out using waterborne lubricant heated to 50 to 90° C. These tactics lead to a substantial improvement in drying performance and can even enable drying at ambient temperature as well as enabling a reduction in thermal energy losses.

The following Examples are presented as specific illustrations of the claimed invention. It should be understood, however, that the invention is not limited to the specific details of the Examples.

EXAMPLES

Test materials

Test material for the backward punch tests: This was commercial spheroidized annealed S45C. The diameter was 30 mmØ and the height was varied from 18 to 40 mm in steps of 2 mm.

Test material for the spike tests: This was commercial spheroidized annealed S45C. The diameter was 25 mmØ and the height was 30 mm.

Treatment Sequences

Sequence A (1) degreasing: commercial degreaser (FINECLEANER 4360, registered trademark and product of Nihon Parkerizing Co., Ltd.), concentration=20 g/L, temperature=60° C., immersion for 10 minutes
(2) water rinse: tap water, 60° C., immersion for 30 seconds
(3) lubrication treatment: lubricant at 60° C., immersion for 10 seconds
(4) drying: 80° C., 3 minutes Sequence B (1) shotblasting: shot diameter=0.5 mm, 5 minutes
(2) water rinse: tap water, 90° C., immersion for 90 seconds
(3) lubrication treatment: lubricant at 70° C., immersion for 5 seconds
(4) drying: ambient temperature (air current), 3 minutes

Test Methods

Backward Punch Test (See FIG. 1)

Figure 1A:
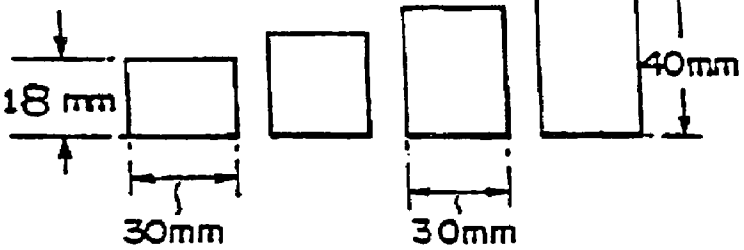
FIG. 1A shows test specimens of selected size and shape used in the backward punch test prior to forming into a cup shape.
Figure 1C:
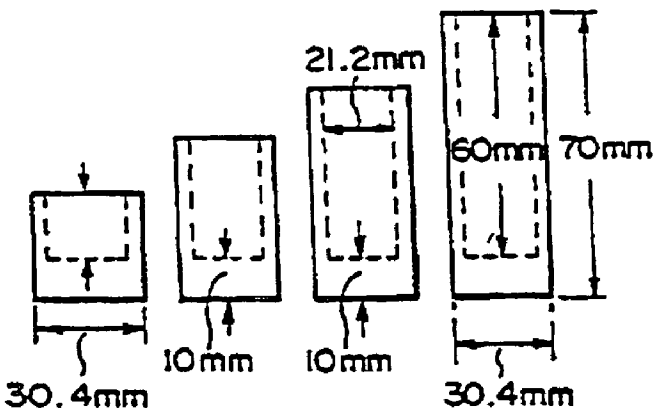
FIG. 1C shows test specimens after forming into a cup shape in the backward punch test.

A series of cylindrical test specimens of selected dimension are shown in FIG. 1A. Specimen 2 was molded with the punch 3 and die 1 of a 200-ton crank press as shown in FIG. 1B to fabricate a cup-shaped molding. A series of resulting cup-shaped moldings, resulting from the backward punch test on the series of cylindrical test specimens of FIG. 1A are shown in FIG. 1C. This molding operation left 10 mm and produced a 50% cross section reduction. The good punch depth (mm) was designated as the largest inside height of the test specimen cups at which the inner surface remained undamaged. The material submitted to the backward punch tests was commercial spheroidized annealed S45C. The test specimens had a diameter of 30 mmØ and a height that was varied from 18 to 40 mm in steps of 2 mm. The die was SKD11; the punch was HAP40; the land diameter was 21.21 mmØ; and the working rate was 30 strokes/minute.

Spike Test (See FIG. 2)

Figure 2A:
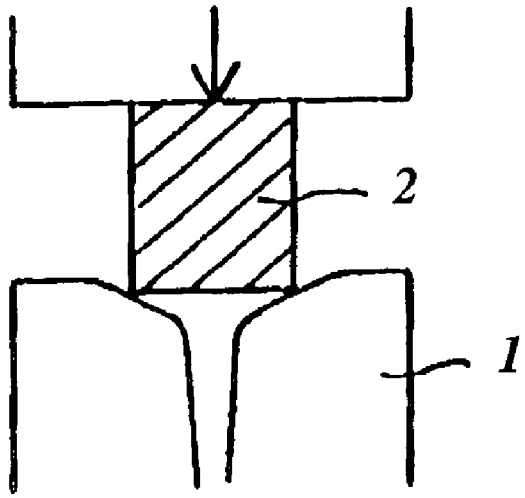
FIG. 2A shows a test specimen in position on a die for the spike test.
Figure 2B:
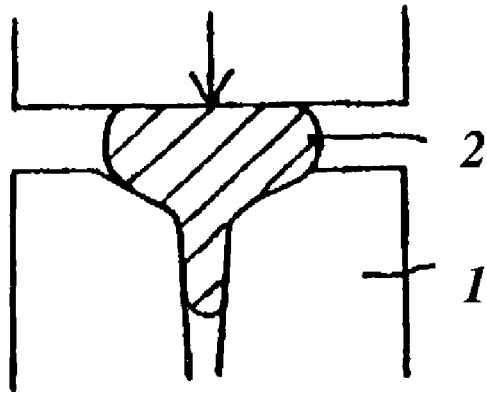
FIG. 2B shows a test specimen during the spike test.

This spike test was based on Japanese Laid-Open (Unexamined or Kokai or A) Patent Application Number Hei 5-7969 (7,969/1993). In this test, a cylindrical specimen 2 is placed as shown in FIG. 2A on a die 1 that has a funnel-shaped inner surface and is placed under a load and the specimen is pressed into the die to carry out forming as shown in FIG. 2B.

This results in the formation of a spike conforming to the shape of the die. The lubricity is evaluated based on the height (mm) of the resulting spike: a higher spike height is indicative of better lubricity. The material used in this test was commercial spheroidized annealed S45C. The diameter of the test specimen was 25 mmØ and its height was 30 mm.

Example 1

Treatment was carried out using sequence A and waterborne lubricant 1 as described below (1 weight % nonionic surfactant was added for dispersion).

Waterborne Lubricant 1
water-soluble inorganic salt: potassium silicate
wax: microcrystalline wax
B/A solids ratio: 1.0
coating weight, g/m2: 15

Example 2

Treatment was carried out using sequence A and waterborne lubricant 2 as described below (1 weight % nonionic surfactant was added for dispersion).

Waterborne Lubricant 2
water-soluble inorganic salt: sodium tetraborate
wax: polyethylene wax
fatty acid metal salt: calcium stearate
B/A solids ratio: 0.5
C/A solids ratio: 0.5
coating weight, g/m2: 15

Example 3

Treatment was carried out using sequence B and waterborne lubricant 3 as described below (1 weight % nonionic surfactant was added for dispersion).

Waterborne Lubricant 3
water-soluble inorganic salt: sodium tetraborate
wax: polyethylene wax
fatty acid metal salt: calcium stearate
B/A solids ratio: 1.0
C/A solids ratio: 0.2
coating weight, g/m2: 15

Example 4

Treatment was carried out using sequence B and waterborne lubricant 4 as described below (1 weight % nonionic surfactant was added for dispersion).

Waterborne Lubricant 4
water-soluble inorganic salt: sodium tungstate and potassium borate (weight ratio=1:2)
wax: paraffin wax
fatty acid metal salt: zinc stearate
B/A solids ratio: 1.5
C/A solids ratio: 0.4
coating weight, g/m2: 15

Example 5

Treatment was carried out using sequence B and waterborne lubricant 5 as described below (1 weight % nonionic surfactant was added for dispersion).

Waterborne Lubricant 5
water-soluble inorganic salt: potassium sulfate
wax: paraffin wax
fatty acid metal salt: calcium stearate
B/A solids ratio: 1.2
C/A solids ratio: 0.4
coating weight, g/m2: 15

Comparative Example 1

Treatment was carried out using sequence A and waterborne lubricant 6 as described below (1 weight % nonionic surfactant was added for dispersion).

Waterborne Lubricant 6
water-soluble inorganic salt: potassium sulfate
wax: paraffin wax
B/A solids ratio: 0.1
coating weight, g/m2: 10

Comparative Example 2

Treatment was carried out using the sequence C described below.

Sequence C
(1) degreasing: commercial degreaser (FINECLEANER 4360, registered trademark and product of Nihon Parkerizing Co., Ltd.), concentration=20 g/L, temperature=60° C., immersion for 10 minutes
(2) water rinse: tap water, room temperature, immersion for 30 seconds
(3) conversion treatment: commercial zinc phosphate conversion treatment agent (PALBOND 181X, registered trademark and product of Nihon Parkerizing Co., Ltd.), concentration=90 g/L, temperature=80° C., immersion for 10 minutes
(4) water rinse: tap water, room temperature, immersion for 30 seconds
(5) soap treatment: commercial reactive soap lubricant (PALUBE 235, registered trademark and product of Nihon Parkerizing Co., Ltd.), concentration=70 g/L, 80° C., immersion for 5 minutes
(6) drying: 80° C., 3 minutes Comparative Example 3

Treatment was carried out using sequence A and waterborne lubricant 7 as described below.

Waterborne Lubricant 7
water-soluble inorganic salt: borax, 10%
solid lubricant: calcium stearate, 10%
oil component: palm oil, 0.5%
surfactant: polyoxyethylene alkyl alcohol, 1%
remainder: water
coating weight, g/m2: 10

Comparative Example 4

Treatment was carried out using sequence A and waterborne lubricant 8 as described below (1 weight % nonionic surfactant was added for dispersion).

Waterborne Lubricant 8
water-soluble inorganic salt: sodium tetraborate
synthetic resin: urethane resin
metal salt of fatty acid: calcium stearate
water-soluble inorganic salt/synthetic resin solids ratio=2/1
calcium stearate/synthetic resin solids ratio=3/1
coating weight, g/m$^2$: 10

The test results are reported in Table 1. As is made clear from Table 1, Examples 1-5, which employed the inventive waterborne lubricant for the plastic working of metals, gave an excellent lubricity using a simple process sequence. The lubricity was poor in Comparative Example 1, in which the component (B)/(A) ratio was outside the range specified for the invention. Comparative Example 2, which gave a lubricity equivalent to that provided by this invention, employed a reactive soap treatment on a phosphate coating. Comparative Example 2, however, required wastewater treatment and bath management and could not be carried out using a simple equipment set up. Comparative Example 2 also imposed a high environmental load because the reactions were accompanied by the production of wastes. A poor lubricity in the spike test was obtained in Comparative Example 3 and Comparative Example 4. Comparative Example 3 employed the invention of Japanese Laid-Open (Unexamined or Kokai or A) Patent Application Number Hei 10-8085, while Comparative Example 4 used synthetic resin as a main component in accordance with the invention of Japanese Laid-Open (Unexamined or Kokai or A) Patent Application Number 2000-63880.

TABLE 1

Results of evaluation

| | no. of steps in treatment sequence | treatment | backward punch depth, mm | spike height, mm |
|---|---|---|---|---|
| Example 1 | 4 | coating type | 60 | 13.1 |
| Example 2 | 4 | coating type | 60 | 13.2 |
| Example 3 | 4 | coating type | 60 | 13.1 |
| Example 4 | 4 | coating type | 60 | 13.1 |
| Example 5 | 4 | coating type | 60 | 13.1 |
| Comp. Ex. 1 | 4 | coating type | 40 | 11.8 |
| Comp. Ex. 2 | 6 | reactive type/ large amounts of waste | 56 | 13.0 |
| Comp. Ex. 3 | 4 | coating type | 56 | 12.5 |
| Comp. Ex. 4 | 4 | coating type | 56 | 12.6 |

As the preceding description has made clear, use of the inventive waterborne lubricant for the plastic working of metals and the inventive method for forming a lubricating coating on metals enables the production of highly lubricating coatings using a simple treatment sequence. Moreover, the lubricant and method of this invention are extremely industrially and commercially useful because they produce little waste and provide an excellent working environment.

Although the invention has been described with reference to preferred embodiments, it is to be understood that variations and modifications may be resorted to as will be apparent to those skilled in the art. Such variations and modifications are to be considered within the purview and scope of the claims appended hereto.

We claim:

1. A waterborne lubricant useful in the plastic working of metals, comprising:

(A) a component of water-soluble inorganic salt and (B) a component of wax in the absence of synthetic resin, wherein said components are dissolved and/or dispersed in water and the (B)/(A) solids weight ratio is 0.3 to 1.5.

2. The waterborne lubricant of claim 1 further comprising:

(C) a metal salt of a fatty acid at a (C)/(A) solids weight ratio of 0.01 to 0.4.

3. The waterborne lubricant of claim 1, wherein the water-soluble inorganic salt (A) is at least one substance selected from the group consisting of sulfates, silicates, borates, molybdates, and tungstates.

4. The waterborne lubricant of claim 1, wherein the wax (B) is a water-dispersed synthetic wax.

5. The waterborne lubricant of claim 4, wherein the water-dispersed synthetic wax has a melting point of 70 to 150° C.

6. The waterborne lubricant of claim 2, wherein the fatty acid metal salt (C) is a fatty acid metal salt obtained by the reaction of $C_{12}$-$C_{26}$ saturated fatty acid with at least one metal.

7. The waterborne lubricant of claim 6, wherein the at least one metal is selected from the group consisting of zinc, calcium, barium, aluminum, magnesium and lithium.

8. A method for forming a lubricating coating, comprising the steps of:

a) applying a waterborne lubricant according to any one of claims 1-5 to a conversion-coating free metal surface; and b) drying said lubricant on said metal surface.

9. The method according to claim 8, wherein the waterborne lubricant is applied in an amount that causes the formation of a 0.5-40 g/m$^2$ lubricating coating after application and drying.

10. The method according to claim 8, further comprising a pre-treating step of shotblasting, sandblasting, alkaline degreasing, and/or pickling the metal surface prior to step a).

11. The method according to claim 8, wherein step a) is performed on the metal surface heated to 60-100° C.

12. The method according to claim 8, wherein the waterborne lubricant applied in step a) has a temperature of 50-90° C.

13. A nonreactive method for forming a lubricating coating useful in the plastic working of metals on a metal surface comprising:

a) applying a waterborne lubricating coating at an add-on of at least 0.5 g/m$^2$ to a conversion coating-free metal surface and b) drying the waterborne lubricating coating;

said waterborne lubricating coating comprising (A) a component of at least one water-soluble inorganic salt and (B) a component of wax, in the absence of synthetic resin, wherein said components are dissolved and/or dispersed in water and the (B)/(A) solids weight ratio is 0.3 to 1.5.

14. The method according to claim 13, further comprising a pre-treating step of shotblasting, sandblasting, alkaline degreasing, and/or pickling the metal surface prior to step a).

15. The method according to claim 13, wherein step a) is performed on the metal surface heated to 60-100° C.

16. The method according to claim 13, wherein the waterborne lubricant applied in step a) has a temperature of 50-90° C.

* * * * *